US008348011B1

(12) United States Patent
Huang

(10) Patent No.: US 8,348,011 B1
(45) Date of Patent: Jan. 8, 2013

(54) EARPLUG CUSHION FOR AN EARPHONE

(75) Inventor: Cheng-Houng Huang, Zhubei (TW)

(73) Assignee: Rextec International Limited, Zhubei (TW)

( * ) Notice: Subject to any disclaimer, the term of this patent is extended or adjusted under 35 U.S.C. 154(b) by 0 days.

(21) Appl. No.: 13/225,426

(22) Filed: Sep. 3, 2011

(30) Foreign Application Priority Data

Aug. 5, 2011 (TW) ..... 100128000 A

(51) Int. Cl.
*H04R 25/02* (2006.01)
*H04R 25/00* (2006.01)

(52) U.S. Cl. ..... 181/135; 181/130; 381/328

(58) Field of Classification Search ..... 181/135, 181/130, 131; 381/328, 380
See application file for complete search history.

(56) References Cited

U.S. PATENT DOCUMENTS 2,430,229 A * 11/1947 Kelsey ..... 381/338
2,487,038 A * 11/1949 Baum ..... 181/135
2,489,277 A * 11/1949 Faralla ..... 181/22
3,882,848 A * 5/1975 Klar et al. ..... 600/559
6,931,142 B2 * 8/2005 Fushimi ..... 381/325
7,113,611 B2 * 9/2006 Leedom et al. ..... 381/322
7,305,992 B2 * 12/2007 Fleming ..... 128/864
7,537,011 B2 * 5/2009 Falco ..... 128/864
7,580,537 B2 * 8/2009 Urso et al. ..... 381/322
7,600,604 B2 * 10/2009 Babcock et al. ..... 181/130
7,681,577 B2 * 3/2010 Blanchard ..... 128/864
7,720,242 B2 * 5/2010 Anderson et al. ..... 381/328
7,778,434 B2 * 8/2010 Juneau et al. ..... 381/328
7,886,745 B2 * 2/2011 Purcell et al. ..... 128/864
8,061,472 B2 * 11/2011 Tiemens ..... 181/135
2009/0034775 A1 * 2/2009 Burton ..... 381/380
2009/0202097 A1 * 8/2009 Tiscareno et al. ..... 381/380
2011/0036661 A1 * 2/2011 Munro ..... 181/135

* cited by examiner

*Primary Examiner* — Edgardo San Martin

(57) ABSTRACT

An earplug cushion for an earphone comprises a central tube part with a sound outlet and a sound inlet fitting with the sound guide tube of the earphone, an outer shield part extending from the sound outlet to the sound inlet for being inserted into the canal, and a buffer part disposed at the tube part next to the sound outlet; according to special and effective design for the buffer part, when the earphone is worn with the earplug cushion, the buffer part becomes twisted and deformed to be adapted to the canal in different sizes snugly without clearances for decreasing oppression to the canal and enhancing quality of the listened sound.

13 Claims, 5 Drawing Sheets

EARPLUG CUSHION FOR AN EARPHONE

BACKGROUND OF THE INVENTION

1. Field of the Invention

The present invention relates to an earplug cushion for an earphone, and, more particularly, to an earplug cushion which is provided with a buffer part capable of being twisted and deformed to adapt to the ear canal snugly without clearances for decreasing oppression and enhancing quality of the listened sound.

2. Description of Related Art

The plug type earphone has a small volume, and the sound emitter thereof can be placed in the ear directly for the user capable of listening electronic sounds without interfering others. Therefore, the earphone, which provides advantages such as lightness, smallness, and portability, has become one of the accessories required by the electronic products such as MP3, mobile phones, personal digital assistants (PDA) or laptop computers.

Referring to FIG. 9, the conventional plug type earphone basically includes an earphone 1 and an earplug cushion 2; the earphone 1 has a sound guide tube 11 extending outward laterally, and the earplug cushion 2 is made of soft rubber with a profile like a jellyfish; the earplug cushion 2 is sleeved with the sound guide tube 11, and fits with the projection ring 111 provided at the sound guide tube 11; when the earphone is worn, the earplug cushion 2 is deformable at the time of being plugged into the ear canal 3.

As it is known, the feeling of each personal individual to the identical sound is more or less different from each other; the structure with regard to the ear and the ear canal of each personal individual such as the shape and the size is not the same. However, the conventional plug type earphone has deficiencies in designing the buffer function and the angular adjustment of the earplug cushion such that when the earphone is worn, the ear canal is oppressed often in case the ear canal is smaller than the earplug cushion in size, and there are clearances between the ear canal and the earplug cushion, and it results in not only the base leaking outward to degrade the quality of sound but also the earphone easily loosening and falling in case the ear canal is larger than the earplug cushion in size.

SUMMARY OF THE INVENTION

The main object of the present invention is to provide an improvement of the earplug cushion to overcome the foregoing deficiencies of the prior art.

To achieve the object, an earplug cushion for an earphone according the present invention comprises a central tube part with a sound outlet and a sound inlet fitting with the sound guide tube of the earphone, an outer shield part with a curved umbrella-shaped profile extending from the sound outlet to the sound inlet for being inserted into the canal, and a buffer part disposed at the tube part next to the sound outlet; according to special and effective design for the buffer part, when the earphone is worn with the earplug cushion, the buffer part becomes twisted and deformed to be snugly adapted to the ear canal in different sizes without clearances for decreasing oppression to the ear canal and enhancing quality of the listened sound.

Further benefits and advantages of the present invention will become apparent after a careful reading of the detailed description with appropriate reference to the accompanying drawings.

DETAILED DESCRIPTION OF THE INVENTION

Figure 1:
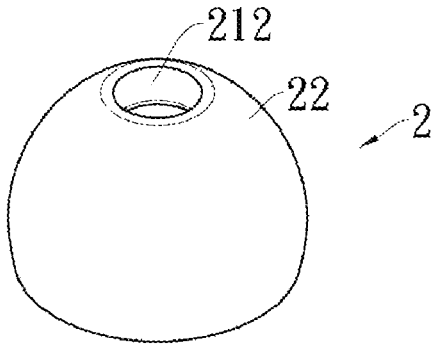
FIG. 1 is a perspective view of the first embodiment of an earplug cushion for an earphone according to the present invention.
Figure 2:
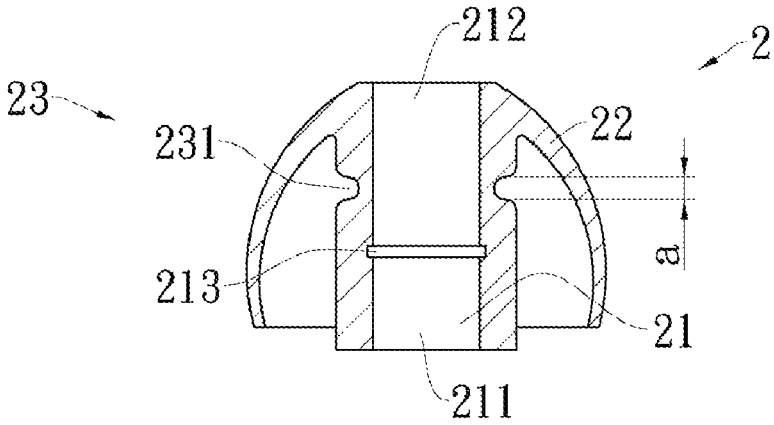
FIG. 2 is a sectional view of the first embodiment of the earplug cushion shown in FIG. 1.

Referring to FIGS. 1 and 2, the first preferred embodiment of an earplug cushion for an earphone in accordance with the present invention is a jellyfish-shaped earplug cushion 2 made of soft rubber which comprises:

a central tube part 21 having a sound inlet end 211, a sound outlet end 212, and a lock-ring recess 213 disposed at the inner wall of the tube part 21 next to the sound inlet end 211;

an elastic outer shield part 22 surrounding the tube part 21 with a curved umbrella-shaped profile extending from the sound outlet end 212 to the sound inlet end 211;

wherein the tube part 21 can be divided into two sections, a half tube section next to the sound inlet and a half tube section next to the sound outlet; the half tube section next to the sound outlet has an outer annular groove 231 with a depth less than the wall thickness of the tube part and a width "a" between 1.0~2.0 mm to constitute a buffer part 23; the lock-ring, recess 213 is located at the half-tube section next to the sound inlet.

Figure 3:
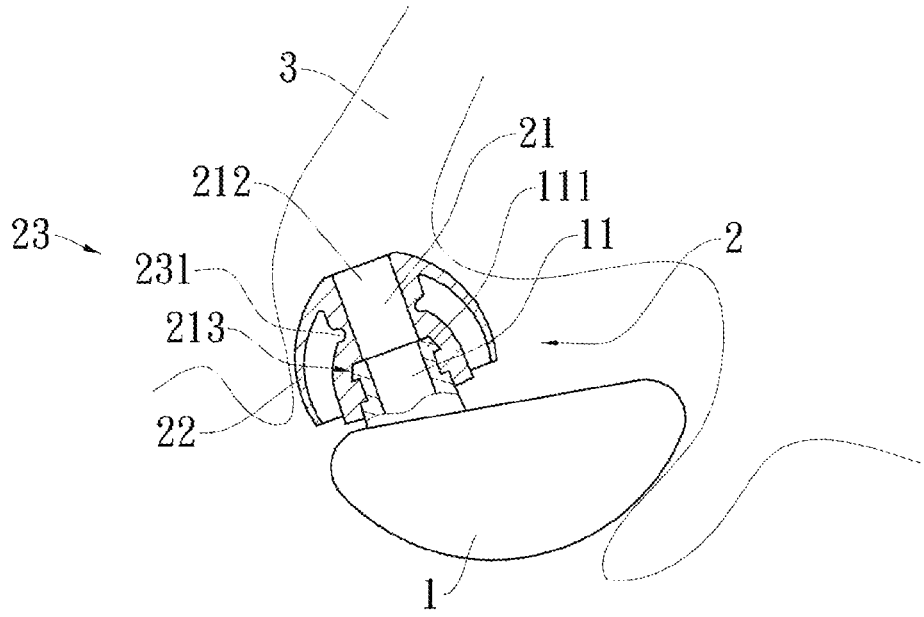
FIG. 3 is a sectional view of the first embodiment of the earplug cushion in association with an earphone illustrating an operation of the earplug cushion being inserted into the ear.
Figure 4:
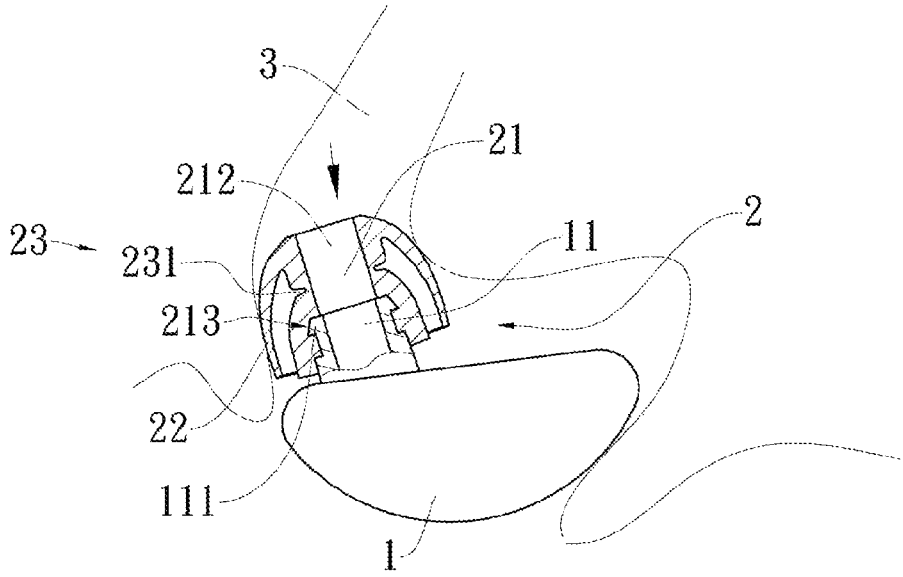
FIG. 4 is another sectional view of the first embodiment of the earplug cushion in association with an earphone illustrating another operation of the ear cushion being inserted into the ear.
Figure 5:
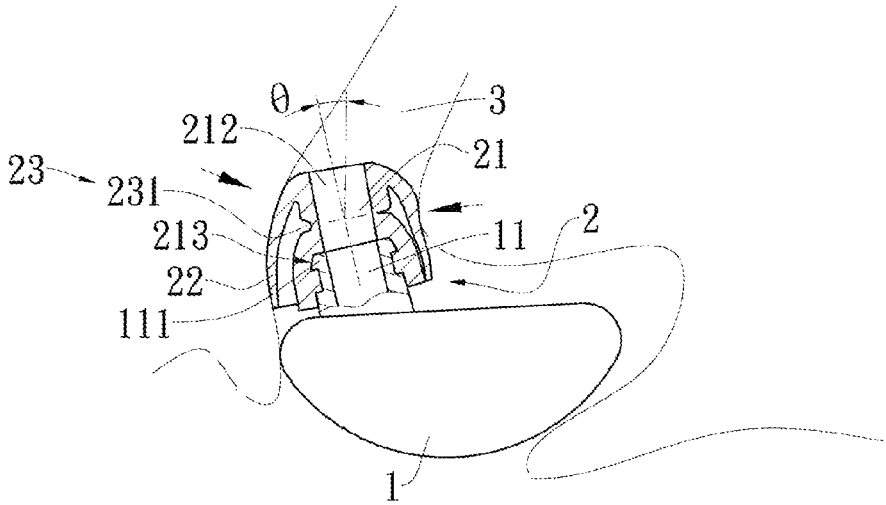
FIG. 5 is a further sectional view of the first embodiment of the earplug cushion in association with the earphone illustrating a further operation of the ear cushion being inserted into the ear.

Referring to FIGS. 3 to 5, when the earplug cushion 2 is in use, the earplug cushion 2 is sleeved with a granular streamline earphone 1 which has a sound guide tube section 11 extending outward laterally, and the sound guide tube section 11 has an enlarged annular end 111 to engage with the lock-ring recess 213 in the tube part 21. It can be seen in FIGS. 4 and 5 that due to the gross height of the earplug cushion 2 being between 6~8 mm, the the width of the outer annular groove "a" shown in FIG. 2 being between 1.0~2.0 mm, and the outer shield part 22 covering the entire tube part 21, the earplug cushion part 23 is subjected to a force with a wave extension effect at the periphery thereof and capable of being bent an effective bending angle θ as shown in FIG. 5 between 0~40 degrees for only the elastic outer shield part of the earplug cushion 2 being twisted and deformed easily and creating effects of buffering and bending with the central tube part 21 keeping the original size without changing; as a result, the sound can pass through the central tube part steadily, and when the earplug cushion 2 is inserted into the ear of anyone of the users, it is capable of adapting to the ear canal of the wearer snugly and passing through the ear canal to deeper inside of the ear with less oppression to the ear canal 3 and no clearances between the earplug cushion 2 and the ear canal 3 for enhancing quality of the sound transmitting via the earplug cushion.

Figure 6:
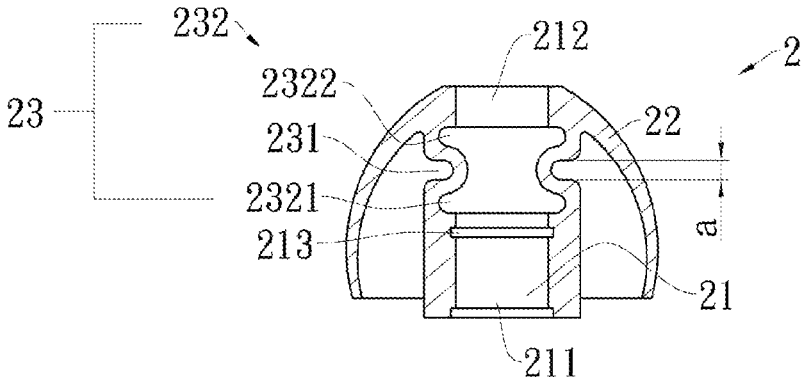
FIG. 6 is a sectional view of the second embodiment of the earplug cushion in accordance with the present invention without.
Figure 7:
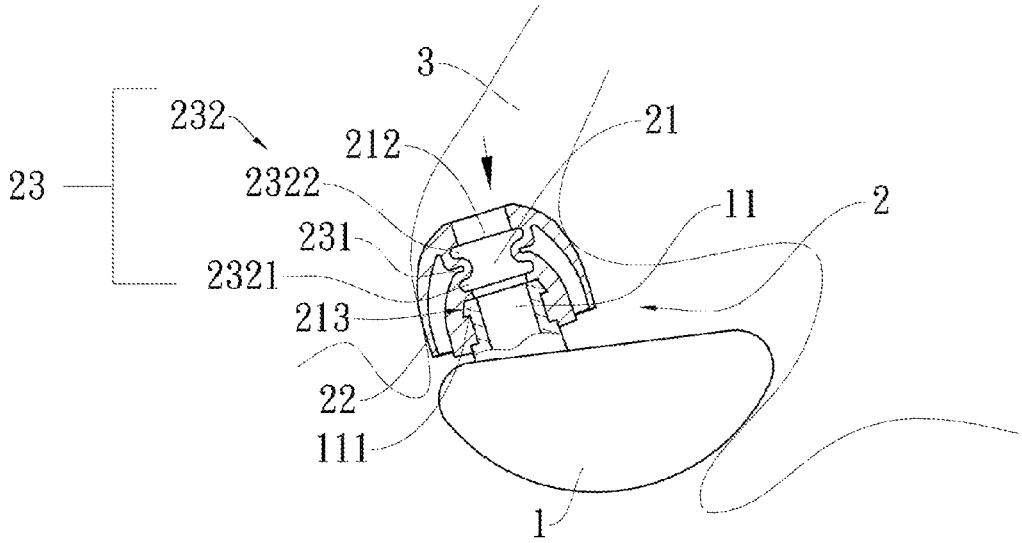
FIG. 7 is a sectional view of the second embodiment of the earplug cushion in association with the earphone illustrating an operation of the earplug cushion inserted into the ear.
Figure 8:
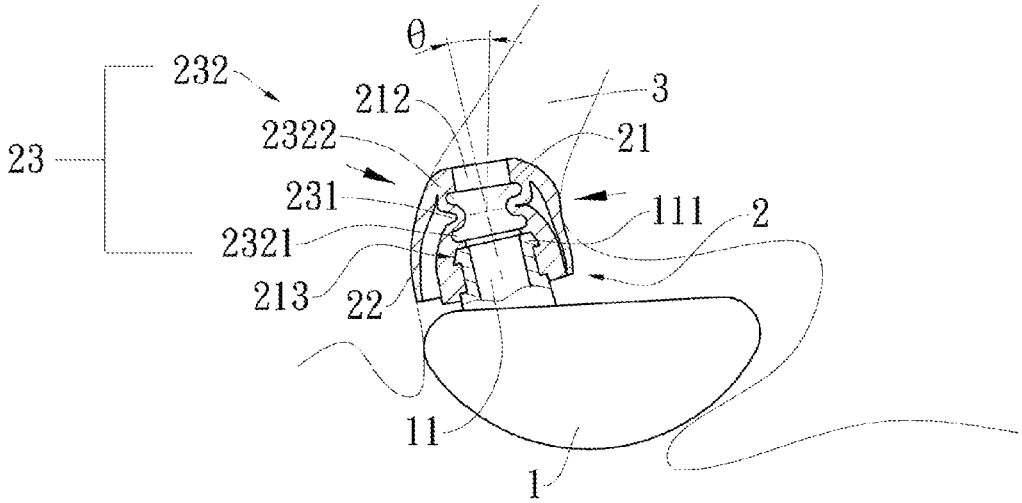
FIG. 8 is a sectional view of the second embodiment of the earplug cushion in association with the earphone illustrating another operation of the earplug cushion inserted into the ear.
Figure 9:
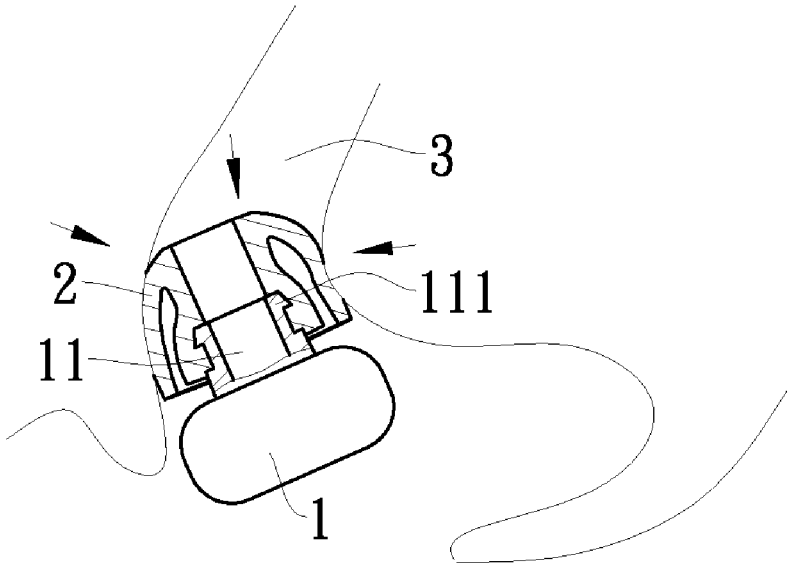
FIG. 9 (Prior Art)
FIG. 9 is a sectional view of the conventional earphone.

Referring to FIGS. 6 to 8, the second preferred embodiment of an earplug cushion for an earphone in accordance with the present invention is illustrated. It can be seen in FIG. 6 that the half tube section next to the sound outlet 212 has a wall thickness less than that of the half tube section next to the sound inlet 211. The buffer part 23 of the second embodiment, which is the half tube section next to the sound output 212, has a wave-shaped deep inward outer annular groove 231 with a depth greater than the wall thickness of the buffer part 23, and a first inner annular groove 2321, and a second inner annular groove 2322 are spaced part by the outer annular groove 231 which is positioned between the first and second inner grooves 231, 2322; the width of the outer annular groove 231 "a" thereof is between 0.5~1.5 mm. Due to the outer annular groove 231 having a large width "a", only the elastic outer shield part 21 of the earplug cushion is twisted and deformed more easily and capable of being bent an effective bending angle θ as shown in FIG. 8 between 0~40 degrees under a condition of the central tube part 21 keeping the original size without changing for obtaining better effects of buffering and bending, and is capable of adapting to the ear canal 3 of anyone of the users snugly and passing through the ear canal to deeper inside of the ear with less oppression and enhancing quality of sound transmitting via the earplug cushion.

Although the invention has been explained in relation to its preferred embodiments, it is to be understood that many other possible modifications and variations can be made without departing from the spirit and scope of the invention as hereinafter claimed.

What is claimed is:

1. An earplug cushion for an earphone comprising:

a central tube part having a size with a uniform inner diameter and wall thickness, having an end being a sound inlet and another end thereof being a sound outlet to form a first half tube section next to the sound inlet and a second half tube section next to the sound outlet;

an elastic outer shield part joining to the sound outlet and extending to a side at which the sound inlet is located to cover the tube part;

wherein the second half tube section is disposed with an outer annular groove which has a specific width with a depth less than the wall thickness of the tube part to form a buffer part capable of being bent an effective bending angle without changing the size of the central tube part such that the elastic outer shield part is twisted and deformed easily in an ear canal and capable of moving deeply inside the ear canal snugly with less oppression to the ear canal and no clearance between the earplug cushion and the ear canal for enhancing quality of sound transmitted via the earplug cushion when the earplug cushion engaging with an earphone is inserted into the ear.

2. The earplug cushion as defined in claim 1, wherein said effective bending angle has a value between 0~40 degrees.

3. The earplug cushion as defined in claim 1, wherein said specific width of the outer annular groove has a value between 0.5~2.0 mm.

4. The earplug cushion as defined in claim 1, wherein the earplug cushion has a height with a value between 6~10 mm.

5. The earplug cushion as defined in claim 1, wherein the earplug cushion has a circular profile or an umbrella-shaped profile.

6. The earplug cushion as defined in claim 1, wherein first half tube section of the tube part has an inner lock-ring recess for engaging with the earphone.

7. An earplug cushion for an earphone comprising:

a central tube part having an end being a sound inlet, another end being a sound outlet, and forming a first half tube section which is next to the sound inlet and a second half tube section which is next to the sound outlet;

an elastic outer shield part joining to the sound outlet and extending to a side at which the sound inlet is located to cover the tube part;

wherein the first half tube section has a size with a first wall thickness, and the second half tube section has a size with a second wall thickness less than the first thickness; the second half tube section is disposed with an outer annular groove which has a specific width with a depth greater than the second wall thickness to form a buffer part which is capable of being bent an effective bending angle without changing the size of the second half section such that the elastic outer shield part is twisted and deformed easily in an ear canal and capable of moving deeply inside the ear canal snugly with less oppression to the ear canal and no clearance between the earplug cushion and the ear canal for enhancing quality of sound transmitted via the earplug cushion when the earplug cushion engaging with an earphone is inserted into the ear.

8. The earplug cushion as defined in claim 7, wherein the buffer part has two inner annular grooves spaced apart by the outer annular groove.

9. The earplug cushion as defined in claim 7, wherein the effective bending angle has a value between 0~40 degrees.

10. The earplug cushion as defined in claim 7, wherein said specific width of the outer annular groove has a value between 0.5~2.0 mm.

11. The earplug cushion as defined in claim 7, wherein the earplug cushion has a height between 6~10 mm.

12. The earplug cushion as defined in claim 7, wherein the earplug cushion has a circular profile or an umbrella-shaped profile.

13. The earplug cushion as defined in claim 7, wherein the first half tube section has an inner lock-ring recess for engaging with the earphone.

* * * * *